US007446785B1

(12) United States Patent
Hewlett et al.

(10) Patent No.: US 7,446,785 B1
(45) Date of Patent: Nov. 4, 2008

(54) HIGH BIT DEPTH DISPLAY WITH LOW FLICKER

(75) Inventors: Gregory J. Hewlett, Blue Bell, PA (US); Gregory S. Pettitt, Rowlett, TX (US)

(73) Assignee: Texas Instruments Incorporated, Dallas, TX (US)

( * ) Notice: Subject to any disclaimer, the term of this patent is extended or adjusted under 35 U.S.C. 154(b) by 498 days.

(21) Appl. No.: 09/637,495

(22) Filed: Aug. 11, 2000

Related U.S. Application Data

(60) Provisional application No. 60/148,249, filed on Aug. 11, 1999.

(51) Int. Cl.
*G09G 5/10* (2006.01)

(52) U.S. Cl. ..... 345/691

(58) Field of Classification Search ..... 345/691–693, 345/147

See application file for complete search history.

(56) References Cited

U.S. PATENT DOCUMENTS

| | | | | | |
|---|---|---|---|---|---|
| 5,751,379 | A * | 5/1998 | Markandey et al. | ..... | 348/759 |
| 5,986,640 | A * | 11/1999 | Baldwin et al. | ..... | 345/596 |
| 6,008,785 | A | 12/1999 | Hewlett et al. | ..... | 345/85 |
| 6,043,801 | A * | 3/2000 | Bassetti | ..... | 345/89 |
| 6,061,049 | A * | 5/2000 | Pettitt et al. | ..... | 345/691 |
| 6,151,011 | A * | 11/2000 | Worley et al. | ..... | 345/692 |
| 6,204,834 | B1 * | 3/2001 | Baker et al. | ..... | 345/75.2 |

OTHER PUBLICATIONS

U.S. Appl. No. 09/370,419, filed Aug. 9, 1999, Morgan et al.
U.S. Appl. No. 09/413,582, filed Oct. 6, 1999, Hewlett et al.
"Frame-Rate Technique Delivers Flicker-Free Motion-Picture Performance," *Electronic Design*, Sep. 18, 2000, pp. 28 (5 pages total).
"DLP Cinema™ Projection: A Hybrid Frame Rate Technique for Flicker-Free Performance" presented by Gregory Hewlett and Gregory Pettitt, Microdisplay 2000 Conference, Boulder, Colorado, Jul. 2000.

* cited by examiner

*Primary Examiner*—Sumati Lefkowitz
*Assistant Examiner*—Srilakshmi K Kumar
(74) *Attorney, Agent, or Firm*—Charles A. Brill; Wade J. Brady, III; Frederick J. Telecky, Jr.

(57) ABSTRACT

A method of and system for displaying a high bit depth pulse width modulated image at a low frame rate without image flicker. The frame period (1902) is divided into a series of refresh periods (1904, 1906, 1908, 1910). The more significant image bits (1912, 1914, 1916) are displayed in every refresh period, while the bits of lesser significance (1918, 1920, 1922) are displayed only during a subset of the refresh periods. The bits of lesser significance ideally are arranged out of phase with one another such that an equal, or comparable, duration of the lesser significant bit periods is included in each of the refresh periods. Because the minimum temporal frequency necessary to avoid flicker is greater for longer bit durations, this method provides a higher frequency for the more significant bits compared to the bits of lesser significance that are less likely to flicker. This provides the advantage of enabling greatly increase bit depth without requiring unnecessarily short bit planes.

9 Claims, 6 Drawing Sheets

| | | | | | | | | |
|---|---|---|---|---|---|---|---|---|
| 1 | 0 | 1 | 0 | 1 | 0 | 1 | 0 | 1 |
| 0 | 1 | 0 | 1 | 0 | 1 | 0 | 1 | 0 |
| 1 | 0 | 1 | 0 | 1 | 0 | 1 | 0 | 1 |

| | | | | | | | | |
|---|---|---|---|---|---|---|---|---|
| 0 | 1 | 0 | 1 | 0 | 1 | 0 | 1 | 0 |
| 1 | 0 | 1 | 0 | 1 | 0 | 1 | 0 | 1 |
| 0 | 1 | 0 | 1 | 0 | 1 | 0 | 1 | 0 |

| | | | | | | | | |
|---|---|---|---|---|---|---|---|---|
| 0 | 3 | 6 | 9 | 12 | 15 | 18 | 21 | 24 |
| 1 | 4 | 7 | 10 | 13 | 16 | 19 | 22 | 25 |
| 2 | 5 | 8 | 11 | 14 | 17 | 20 | 23 | 26 |

| | | | | | | | | |
|---|---|---|---|---|---|---|---|---|
| 0 | 0 | 0 | 0 | 0 | 0 | 0 | 0 | 0 |
| 0 | 1 | 0 | 1 | 0 | 1 | 0 | 1 | 0 |
| 1 | 1 | 1 | 1 | 1 | 1 | 1 | 1 | 1 |

| | | | | | | | | |
|---|---|---|---|---|---|---|---|---|
| 0 | 0 | 0 | 0 | 0 | 0 | 0 | 0 | 0 |
| 1 | 0 | 1 | 0 | 1 | 0 | 1 | 0 | 1 |
| 1 | 1 | 1 | 1 | 1 | 1 | 1 | 1 | 1 |

| | | | | | | | | |
|---|---|---|---|---|---|---|---|---|
| 0 | 0 | 1 | 0 | 1 | 1 | 0 | 0 | 1 |
| 0 | 1 | 1 | 0 | 0 | 1 | 0 | 1 | 1 |
| 0 | 0 | 1 | 0 | 1 | 1 | 0 | 0 | 1 |

| | | | | | | | | |
|---|---|---|---|---|---|---|---|---|
| 0 0 0 | 0 1/2 0 | 0 1 0 | 1/2 0 0 | 1/2 1/2 0 | 1/2 1 0 | 1 0 0 | 1 1/2 0 | 1 1 0 |
| 0 0 1/2 | 0 1/2 1/2 | 0 1 1/2 | 1/2 0 1/2 | 1/2 1/2 1/2 | 1/2 1 1/2 | 1 0 1/2 | 1 1/2 1/2 | 1 1 1/2 |
| 0 0 1 | 0 1/2 1 | 0 1 1 | 1/2 0 1 | 1/2 1/2 1 | 1/2 1 1 | 1 0 1 | 1 1/2 1 | 1 1 1 |

| | | | | | | | | |
|---|---|---|---|---|---|---|---|---|
| 0 | 1 | 1 | 0 | 0 | 1 | 0 | 1 | 1 |
| 0 | 0 | 1 | 0 | 1 | 1 | 0 | 0 | 1 |
| 0 | 1 | 1 | 0 | 0 | 1 | 0 | 1 | 1 |

| | | | | | | | | |
|---|---|---|---|---|---|---|---|---|
| 0 | 0 | 0 | 0 | 1 | 0 | 1 | 1 | 1 |
| 0 | 0 | 0 | 1 | 0 | 1 | 1 | 1 | 1 |
| 0 | 0 | 0 | 0 | 1 | 0 | 1 | 1 | 1 |

| | | | | | | | | |
|---|---|---|---|---|---|---|---|---|
| 0 | 0 | 0 | 1 | 0 | 1 | 1 | 1 | 1 |
| 0 | 0 | 0 | 0 | 1 | 0 | 1 | 1 | 1 |
| 0 | 0 | 0 | 1 | 0 | 1 | 1 | 1 | 1 |

HIGH BIT DEPTH DISPLAY WITH LOW FLICKER

This application claims priority under 35 USC § 119(e)(1) of provisional application No. 60/148,249 filed Aug. 11, 1999.

CROSS-REFERENCE TO RELATED APPLICATIONS

The following patents and/or commonly assigned patent applications are hereby incorporated herein by reference:

| Patent No. | Filing Date | Issue Date | Title |
|---|---|---|---|
| 09/370,419 | Aug. 9, 1999 | | Spatial-Temporal Multiplexing for High Bit-Depth Resolution Displays |
| 09/413,582 | Oct. 6, 1999 | | Non-Terminating Pulse Width Modulation for Displays |

FIELD OF THE INVENTION

This invention relates to the field of display systems, more particularly to display systems using pulse width modulation, still more particularly to display systems using pulse width modulation to achieve high bit depth display.

BACKGROUND OF THE INVENTION

The fundamental technology of cinema film projection largely has remained unchanged for over one hundred years. A filmstrip containing a series of images is passed through a powerful light beam at 24 frames per second. The light passing through the filmstrip is shuttered twice to produce two images of each frame. After each image is shuttered twice, the film is advanced to the next image and the shuttering repeated. The result is a 48 Hz image sequence produced by a 24 frame per second source. While this produces a pleasing image while limiting the amount of film used to produce a movie, the frame rate is insufficient to eliminate flicker during bright image sequences.

Recently, new technologies have emerged to challenge film distribution and projection. These new technologies use micromirror or liquid crystal spatial light modulators to spatially modulate light using digitized image data. In many cases, these technologies provide superior image quality while greatly reducing film distribution costs and eliminating the image degradation that occurs due to the wear and tear associated with traditional film projection.

Some of these new technologies operate digitally—that is, each pixel of the modulator is either on or off, fully illuminating, or not illuminating, a corresponding image pixel. Digital modulators produce gray scale images by temporally alternating between the on and off states and using a receptor such as the human eye to integrate the light received from each pixel over a given time. In a similar manner, some display systems sequentially produce three single color images which are combined by the viewer to achieve the perception of a three-color image.

One of the difficulties encountered using digital spatial light modulators is the provision of sufficient bit depth. Images digitized to bit resolutions of only 8 or 9 bits per color per pixel can produce false contouring artifacts—perceived as display regions having a constant intensity with a sharp change in intensity to the next region, instead of the intended gradually changing intensity through the various regions. These objectionable contouring artifacts can be eliminated by increasing the number of data bits used to represent each pixel. Unfortunately, increasing the number of image bits increases the necessary system bandwidth. Furthermore, the least significant bits (LSBs) of the image have such short display times that the system cannot load the next bit of data into to modulator during the bit display period.

The display period for each bit also depends on the frame rate of the display. Slower frame rates allow longer frame periods and enable greater bit depths. The slower frame rates, however, are prone to flickering. Higher frame rates eliminate flicker, but limit the bit depth of the image since the display time of the LSBs becomes shorter than the modulator load time. What is needed is a method and system that allows both a high frame rate to eliminate flicker, and sufficiently long data display periods.

SUMMARY OF THE INVENTION

Objects and advantages will be obvious, and will in part appear hereinafter and will be accomplished by the present invention which provides a method and system for low flicker projection of high bit depth images from low frame rate sources. One embodiment of the claimed invention provides a method of displaying image data bits in a pulse width modulated display system. The method comprises the steps of: receiving an image data word for an image pixel, the image data word comprised of at least a first and second image data bit; dividing an image frame period into at least two refresh periods; displaying the first image data bit during some, but not all, of the refresh periods; and displaying the second image data bit during more of the refresh periods than the first image data bit was displayed during.

According to a second embodiment of the present invention, a method of allocating a frame period to image data bits is provided. The method comprises the steps of: dividing a frame period into at least two refresh periods; allocating a display period to each image data bit in an m-bit image data word; determining the a minimum temporal frequency for each of the image data bits, the minimum temporal frequency being necessary to prevent each image data bit from appearing to flicker; and displaying each image data bit in enough of the refresh periods to achieve the minimum temporal frequency, wherein not all of the image data bits are displayed in all of the refresh periods.

According to a third embodiment of the present invention, a display system is provided. The display system comprises: a controller for receiving image data and processing the image data, the image data comprised of m image bits for each pixel of an image, the processing allocating a series of refresh periods to the image bits such that not all of the image bits are displayed in the same number of refresh periods; and a display device in electrical communication with the controller, the display device for providing a modulated light beam to each of an array of image pixels, the modulation in response to the processed image data from the controller.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF THE PREFERRED EMBODIMENTS

A new data projection technique and system have been developed that allow pulse width modulated display systems to produce high bit depth images from low frame rate source material without appreciable flicker. One embodiment of this technique enables a micromirror-based display system to achieve an effective bit depth of 13.8 bits while displaying 24 Hz source material and avoiding flicker. A key to this achievement is the realization that the frame rate necessary to avoid flicker increases as the brightness of the image increases, and that the various bits of image data can be displayed at various frame rates. As a result, the most significant bits of image data-which represent the brightest portion of the image—an be displayed at a higher effective frame rate than the lower bits of data.

The present invention will be discussed in terms of systems using binary data in which each data bit is displayed in order of significance during a single display period. It should be understood that the same teachings are also applicable to display systems that display each bit using one or more display periods arranged in any order during an image frame. Likewise, the teachings of the present disclosure are also applicable to image display systems that use non-binary image bit values, and to systems that vary the intensity of light during a frame.

Image Flicker:

Flicker is an artifact where the image seems to flash rather than retain a steady brightness. The study of the phenomenon of flicker was stimulated at the end of the nineteenth century with the introduction of motion picture films and again in the twentieth century with the introduction of television. Ferry and Porter studied the frequency of repetition necessary to achieve steady brightness. Ferry and Porter found that the frequency at which flicker can be observed increased linearly with the logarithm of luminance (known as the Ferry-Porter Law). The frequency at which the modulated source becomes steady is known as the critical flicker frequency (CFF).

Figure 1:
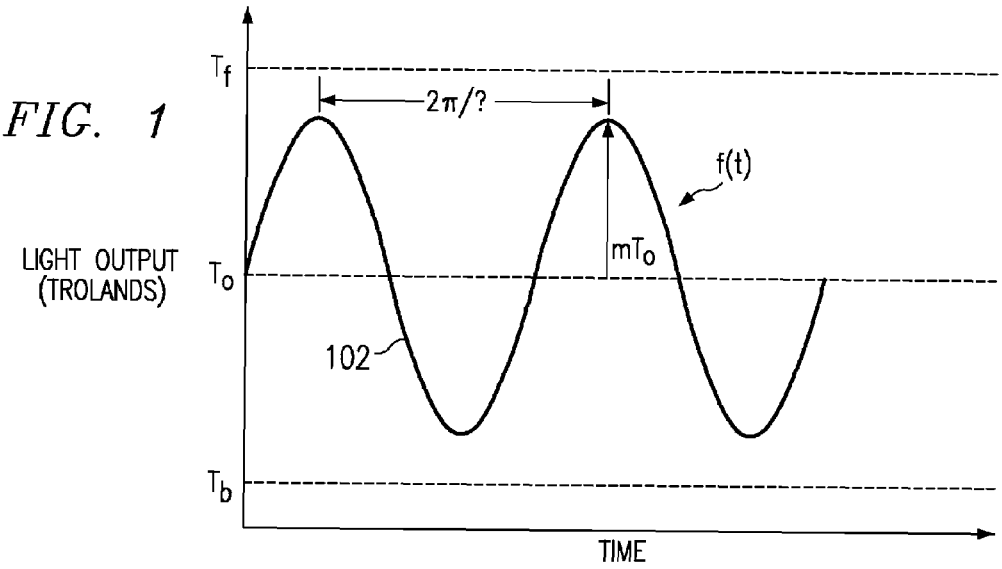
FIG. 1 is a plot of the output intensity of a sinusoidally varying light source.

A modern approach to the analysis of the flicker phenomena uses the principles of linear system analysis and Fourier analysis techniques. The source light output can be modeled using a sine wave. FIG. 1 shows the intensity 102 of a sinusoidally varying light source whose response over time obeys the following equation:

$$f(t)=T_O*[1+m*\sin(wt)]$$

where $T_O=T_f*(1+1/CR)/2$ $CR=T_f/T_b$ is the contract ratio of the source $T_f$ is the maximum brightness of the source $T_b$ is the minimum brightness of the source The source's amplitude is controlled by the parameter 'm' where $0 \leqq m \leqq 1$. Additionally, the illuminance of the source is measured in Trolands (td). The Troland is defined in order to measure the illuminance at the surface of the retina of the eye. The Troland is thus calculated as the product of the light source luminance ($cd/m^2$) and the area of the pupil ($mm^2$)

A model of the eye's temporal response can be found in "Contrast Sensitivity of the Human Eye and Its Effects on Image Quality," by Peter Barten. Barten has developed an extensive model that has proven able to match a large body of data collected on the eye's temporal and spatial responses. The model computes a contrast sensitivity measure, S(w), based on a number of inputs including target size, adaptation level, and the eye's integration time. The CFF is defined as the frequency, w, at which S(w)=1/m.

This model of temporal contrast sensitivity will be used for the remainder of our analysis. Details of the model may be found by consulting Barten's book.

Figure 2:
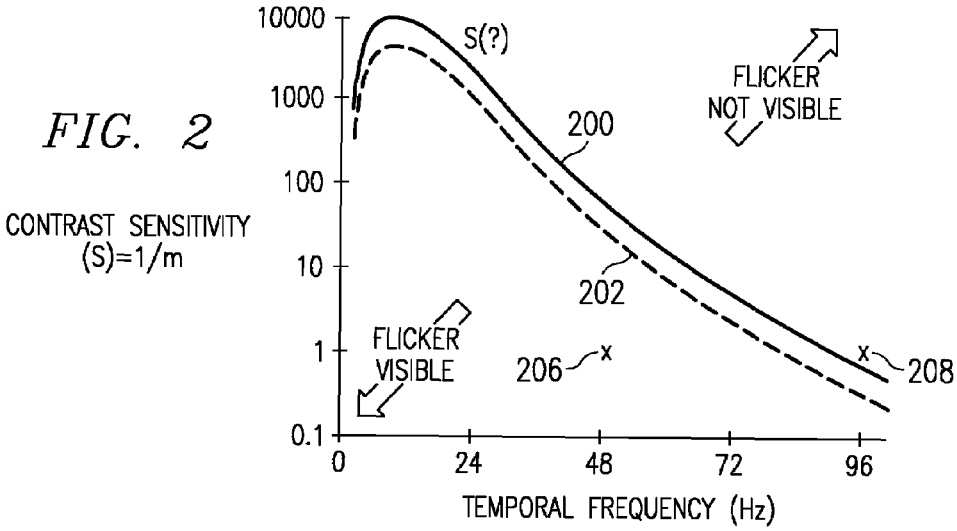
FIG. 2 is a plot of the contrast sensitivity measurement over a range of temporal frequencies.

FIG. 2 shows a plot of S(w) 200 as a function of frequency. No flicker is perceived when a light source exhibits a modulation value (1/m) above the curve S(w). Flicker is perceived, however, if the modulation value is below the curve. FIG. 2 assumes the values shown in Table 1.

TABLE 1

Assumed Parameters in Barten Model of FIG. 2

| Parameter | Description | Value Used |
|---|---|---|
| a | aspect ratio | 1.85 |
| W | screen width | 50 ft. |
| b | distance from screen (in screen heights) | 2 |
| $L_f$ | full brightness luminance level | 12 fL |
| $X_0$ | target width | 50 degrees |
| $Y_0$ | target height | 28 degrees |

The S(w) curve is useful in the design of projection systems because if any frequency components of the light projection lines within this curve, the viewer will perceive flicker. The goal is to project a light waveform that has no frequency components inside the curve.

One more element, however, is necessary to the analysis. As the oscillating target reduces in size, the curve moves down. In other words, a constant full white screen oscillating about mean intensity To does not have the same flicker threshold characteristics as a smaller object on the screen oscillating at the same mean intensity. FIG. 2 shows a second plot of S(w) 202 that represents an oscillating target $1/16^{th}$ the area of the original target. This second plot 202 represents video content typical of that contained in motion pictures. The full screen plot 200 represents the worst case for flicker, while the smaller target plot 202 represents a more typical case.

Figure 3:
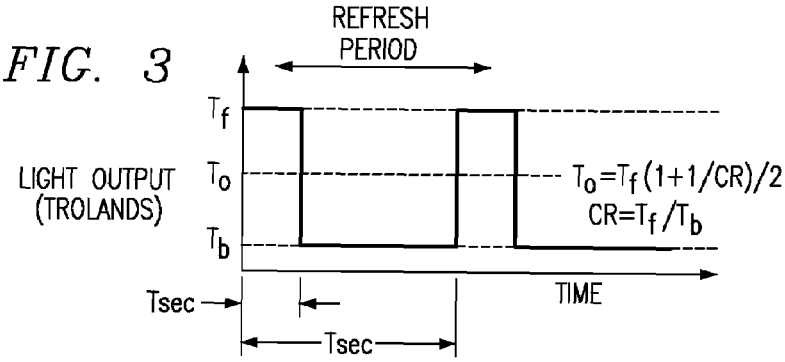
FIG. 3 is a plot of display intensity over time for a refresh period comprised of a single light pulse.

A typical display system, however, does not use sinusoids to create an output. Projection system using a micromirror as the modulation device, for example, generate output consisting of pulses of light. FIG. 3 shows an example of a single pulse of light for each given frame time. The pulse is characterized as having a duration of τ seconds within a frame period of T seconds. In order to use the Barten model, this pulse must be characterized using a Fourier series. The frequency of interest is the first harmonic, which exists at the frequency of the frame rate. This term can be used to compute the value of m.

$$m = \frac{4*(CR-1)}{\pi*(CR+1)}*\sin\left(\frac{\pi-\tau}{T}\right)$$

where

T is the frame time (sec.)

τ is the pulse duration (sec.)

CR is the contrast ratio

The CFF can now be computed for the pulses of light generated by film and by PWM displays. This is accomplished by computing the value of m based on the pulse duration (τ), frame time (T), and contrast ratio (CR) of the display. This value of m can then be compared to the temporal contrast sensitivity function, S(w), to determine if flicker will be perceived.

Figure 4A:
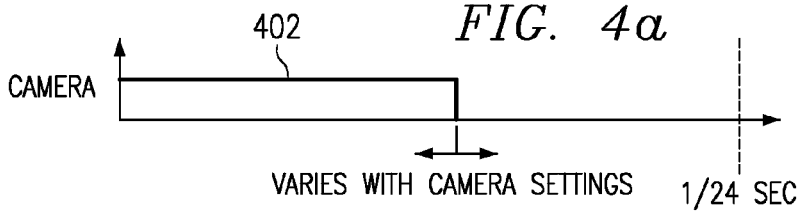
FIG. 4*a* is a plot of a single 24 Hz frame period showing the shutter period of a camera.

Film Projection and Flicker:

Film is recorded at 24 Hz in order that as it is projected, it will give the appearance of continuous motion. FIG. 4*a* illustrates the shutter period 402 of a camera operating a 24 Hz. If film were projected at significantly lower rates, for example 10 Hz, a viewer watching an object moving across the screen would perceive distinct static images rather than perceive the object as moving. At 24 Hz, which is comfortably above the perceived motion threshold, the viewer perceives an object moving rather than a series of static images.

Figure 4B:
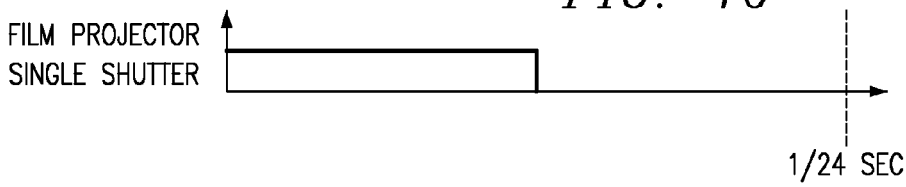
FIG. 4*b* is a plot of a single 24 Hz frame period showing the shutter period for a single-shuttered projector.
Figure 4C:
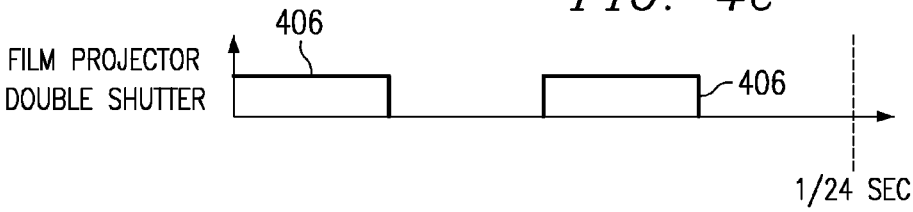
FIG. 4*c* is a plot of a single 24 Hz frame period showing the shutter period for a double-shuttered projector.

Simple 24 Hz projection as shown in FIG. 4*b*, however, would not be sufficient to avoid flicker. To mitigate the flicker, film is projected at 48 Hz, twice the rate that the film is recorded. As illustrated by FIG. 4*c*, every recorded image of 24 Hz film is shown twice using a double shuttering technique. This can be modeled as a 48 Hz pulse waveform with an 50% duty cycle.

Figure 4D:
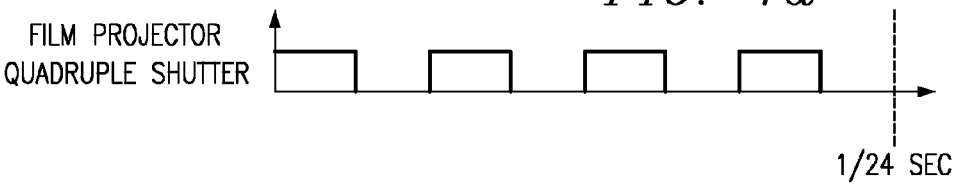
FIG. 4*d* is a plot of a single 24 Hz frame period showing the shutter period for a quadruple-shuttered projector.

Revisiting the temporal sensitivity model shown in FIG. 2, we see that even for double-shutter projection (48 Hz) of a full white screen, flicker easily can be seen because it is well within the flicker sensitivity curve. Point 206 marks this 48 Hz frequency component of the light waveform 406 generated by the double shutter shown in FIG. 4*c*. As can be seen by point 208 in FIG. 2, a quadruple shutter (96 Hz), shown in FIG. 4*d*, is needed to eliminate flicker altogether.

This is the worst case analysis for film flicker, however. For typical film content, two mitigating factors must be considered. The average picture level is less than 20% of full brightness and the scene is made up of complex spatial image components rather than a flat field. These two factors allow most film content to be displayed without producing unwanted flicker. Thus, a viewer might not normally see flicker in film projection, but will see flicker, for example, in a solid bright sky scene or an animated scene with a lightly colored solid background.

PWM Display:

Unlike film, which generates various intensity levels with amplitude modulation, the DMD utilizes pulse-width modulation. The duty cycle of film projection is constant (50% in the example above). The duty cycle of the DMD, however, varies from pixel to pixel to create in the human vision system the perception of various intensities.

Figure 5A:
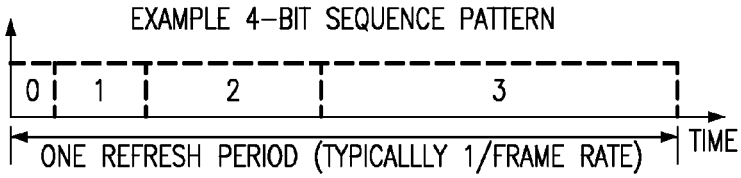
FIG. 5*a* is a timeline showing the division of the operating refresh period into bit segments.
Figure 5B:
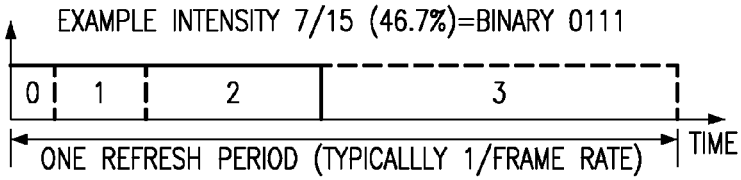
FIG. 5*b* is a timeline showing the division of the bit segments of FIG. 5*a* used to display certain image data.
Figure 5C:
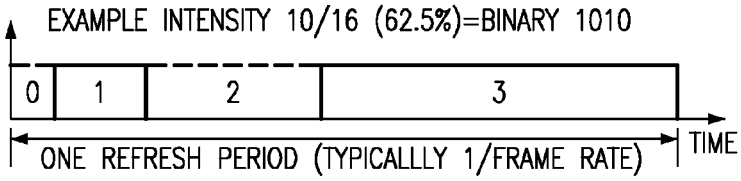
FIG. 5*c* is a timeline showing the division of the bit segments of FIG. 5*a* used to display certain image data.

These light intensities from the DMD are produced by a process of pulse width modulation (PWM), in which the light is modulated over the operating refresh time. The digital video signal is converted to this PWM format. This is done by assigning each bit plane of video data (a bit plane is a single given bit for each pixel of an image) to a segment of time within the operating refresh time. FIG. 5*a* shows the division of the operating refresh time into bit segments. FIGS. 5*b* and 5*c* illustrate how two example intensity values are generated by a binary PWM sequence pattern (for simplicity, only 4 bits of image data are shown).

In the binary PWM pixel representation, a pixel's least significant bit (LSB) consumes $1/(2^n-1)$ of the total refresh period, where n is the number of bits per color. The LSB+1 bit consumes double the LSB time. This pattern continues for all bits of the given pixel. Note in FIG. 5*a* how the LSB (bit 0) is one half the duration of bit 1; bit 1 is half the duration of bit 2; and so on. The human vision system effectively integrates the pulsed light to form the perception of desired intensity. The gray scale perceived is proportional to the percentage of time the mirror is "on" during the refresh time.

Taking television source as an example, we note that the source frame rate is 60 Hz. To achieve 8 bits of resolution, the LSB for the television application would be 65 μs if it were displayed once per frame. The LSB+1 would have an assigned duration of twice that duration (130 μs), and so on.

Figure 6A:
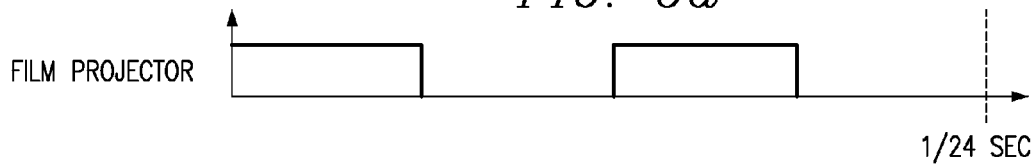
FIG. 6*a* is a timeline of a single 24 Hz frame period showing the two refresh periods produced by a double-shuttered film projector.
Figure 6B:
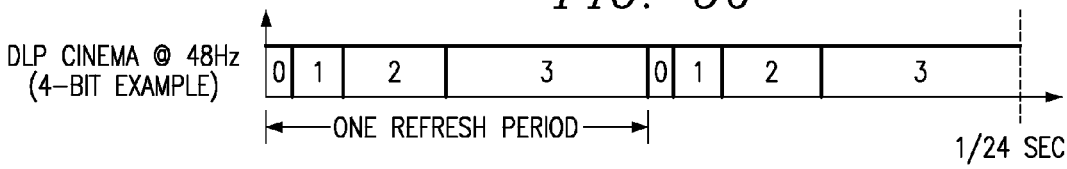
FIG. 6*b* is a timeline of a single 24 Hz frame period showing the two refresh periods produced by a PWM display system replicating the image data twice.

PWM Frame Replication:

One method used in the prior art to reduce flicker in PWM display systems replicates a single frame of image data. For projection of film source, if we wish to match the performance of film we would choose an operating refresh frequency of 48 Hz, not 24 Hz. Thus, all of the image bits are displayed twice as shown in FIG. 6*b*. This method of frame replication functionally is the same as the method shown in FIG. 6*a* of opening the shutter of a film projector twice during each image frame. Because there is no actual film that must mechanically be advanced, there is no need for an off time between frames. Thus, a bit sequence such as is illustrated in FIG. 6*b* is possible.

At a 48 Hz frame rate, PWM projection systems are susceptible to flicker. Unlike film display systems in which the flicker increases as the brightness increases, maximally bright scenes do not produce flicker as light constantly is displayed. For bright scenes less than full on, however, there is a strong 48 Hz frequency component to the light waveform, resulting in flicker similar to that of film projection.

Figure 6C:
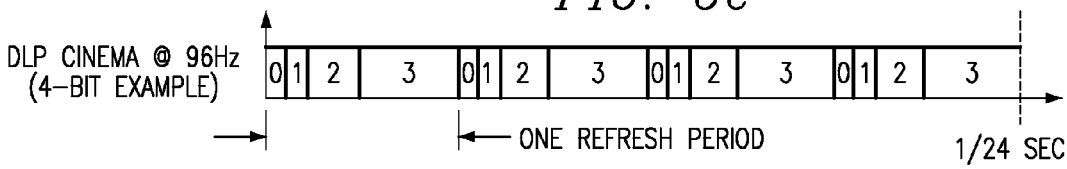
FIG. 6*c* is a timeline of a single 24 Hz frame period showing the four refresh periods produced by a PWM display system replicating the image data four times.

An operating refresh rate of well above 48 Hz is necessary to eliminate flicker completely. Recalling FIG. 2, a refresh rate of around 96 Hz is necessary to eliminate flicker completely (point 208 of FIG. 2). A refresh rate of 96 Hz results in each bit of digital video being displayed four times, as shown in FIG. 6*c*, during each frame. Lower refresh rates are possible, with an increasing risk of image flicker. Higher rates increase the necessary data bandwidth without further reducing image flicker.

The problem, however, is that to ensure the most reliable control of the spatial light modulator elements, for example the mirrors on a micromirror device, the duration of each image bit must exceed a minimum bit length. For the 96 Hz refresh rate shown in FIG. 6*c*, the LSB of a 12 bit image signal is 2.5 μs. While it is possible to display a bit for this short duration of time, LSB periods below approximately 10 μs reduce the reliability of the micromirror operation and may require blanking periods to load the next bit plane into the mirror array. These blanking periods reduce both the brightness and the contrast ratio of the image. Thus, there is a trade-off between operating refresh rate and length of the LSB. If the operating refresh rate is too fast, the LSB becomes too short. But if the operating refresh rate is too large, the result is flicker.

Bit Independence of PWM Displays:

The solution to this seemingly unavoidable tradeoff lies in the realization that each bit is displayed entirely independent from other bits. In other words, the display electronics system is designed such that bit sequences are programmable according to an independent bit-by-bit specification. Thus, we may display the given bits of the 24 Hz source in such a manner that the more significant bits can be shown at multiples of 24 Hz (48 Hz, 72 Hz, 96 Hz, or greater), while the LSBs can be shown as low as 24 Hz.

Figure 7:
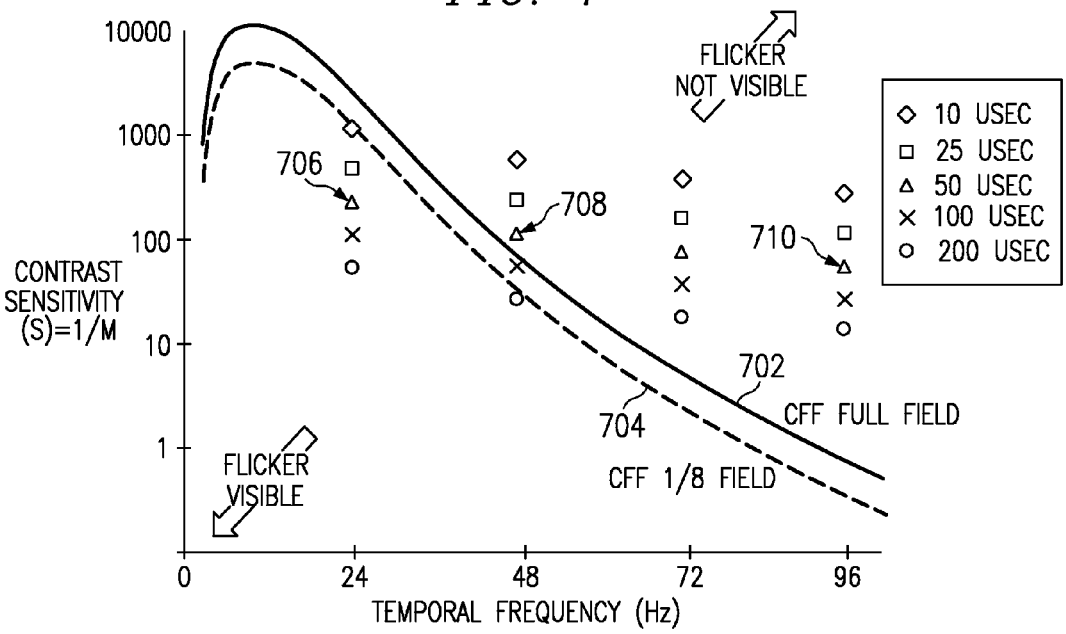
FIG. 7 is a plot of the contrast sensitivity measurement over a range of temporal frequencies showing the contrast sensitivity of various bit durations at various frequencies.

Recalling the temporal sensitivity model, FIG. 7 is a plot of the flicker sensitivity curve, $S(\omega)$, showing the critical flicker frequency for a full image field 702 and a smaller ⅛ image field 704. FIG. 7 also plots the contrast sensitivity of an image bit for several bit durations at refresh rates of 24, 48, 72, and 96 Hz. As can be seen, a 50 μS bit flickers at a 24 Hz refresh rate 706 but not at a 48 Hz refresh rate 708. A refresh rate of 96 Hz is bit well beyond the critical flicker frequency.

Figures 8, 9, 10, 11, 13, 14, 15:
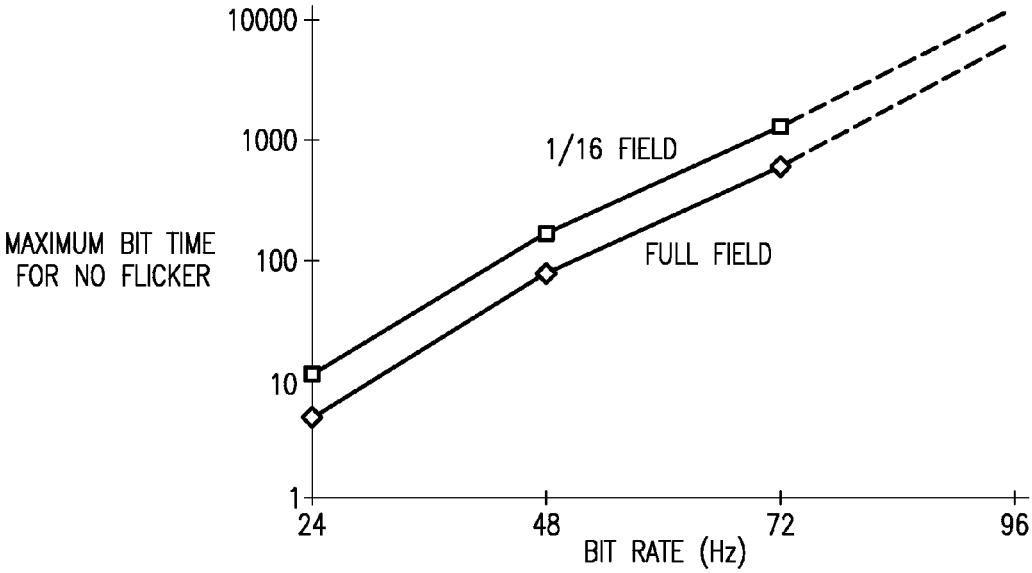
FIG. 8 is a plot showing the maximum flicker-free bit time for full-field and $1/16^{th}$ field images over a range of bit rates.
FIG. 9 is a plan view of a 3×9 array of image pixels showing a first bit mask used for spatial temporal multiplexing.
FIG. 10 is a plan view of the 3×9 array of image pixels of FIG. 9 showing a second bit mask used in conjunction with the bit mask of FIG. 9.
FIG. 11 is a plan view of the 3×9 array of image pixels showing the decimal value for each pixel in the array.
FIG. 13 is a plan view of the 3×9 array of image pixels showing the binary data used during a first refresh period to display the LSB of the intensity data shown in FIG. 11.
FIG. 14 is a plan view of the 3×9 array of image pixels showing the binary data used during a second refresh period to display the LSB of the intensity data shown in FIG. 11.
FIG. 15 is a plan view of the 3×9 array of image pixels showing the binary data used during a first refresh period to display the middle bit of the intensity data shown in FIG. 11.

FIG. 7 shows that if a bit is only 10 μs, it need only be refreshed at 24 Hz to avoid flicker for typical partial frame movie content 704. At 48 Hz, a bit of 200 μs is right below the threshold of flicker. FIG. 8 illustrates the same data in the form of a plot of the maximum flicker-free bit duration over frame refresh rates of 24, 48, and 72 Hz.

To produce high bit depth, flicker-free images, each image bit is independently displayed at a frame rate sufficient to avoid flicker. Thus, the image bits are allowed to have different frame rates. For example, the LSB is shown at only 24 Hz; more significant bits are shown at 48 Hz; and the majority of bits are displayed at 96 Hz or greater. Table 2 is a simplified version of a hybrid frame rate employed in cinema quality PWM display systems. As explained below, the bit durations shown in Table 2 are not all multiples of two as a result of the frame rate differences. The refresh rates listed in Table 2 are sufficiently beyond the threshold for flicker, but each bit duration is long enough to allow efficient, consistent and reliable control of the micromirror device.

TABLE 2

Sample Bit Durations for High Bit Depth Display

| bit | bit segment duration (μs) | operating refresh rate (Hz) |
|---|---|---|
| 0 (LSB) | 10.0 | 24 |
| 1 | 10.0 | 48 |
| 2 | 20.0 | 48 |
| 3 | 20.0 | 96 |
| 4 | 40.0 | 96 |
| . . . | . . . | . . . |
| MSB | >200.0 | >96 |

Figures 12, 16, 17, 18, 19:
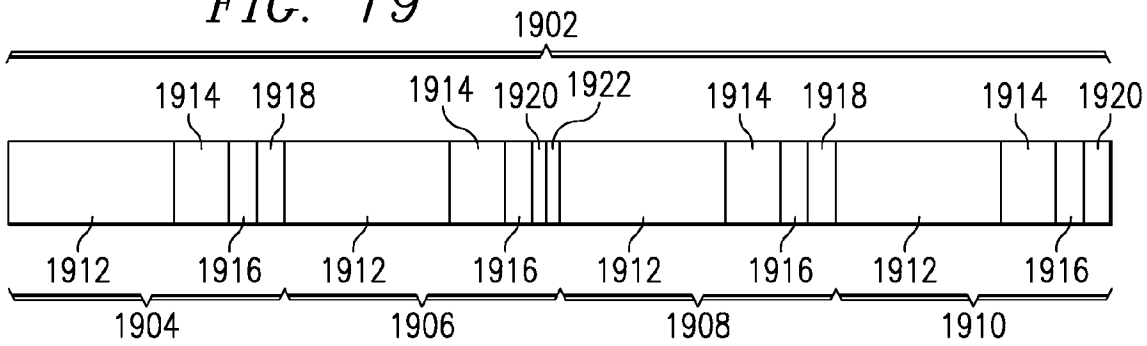
FIG. 12 is a plan view of the 3×9 array of image pixels showing the duty cycle for each of the three spatial-temporal bits used to represent the intensity value shown in FIG. 11.
FIG. 16 is a plan view of the 3×9 array of image pixels showing the binary data used during a second refresh period to display the middle bit of the intensity data shown in FIG. 11.
FIG. 17 is a plan view of the 3×9 array of image pixels showing the binary data used during a first refresh period to display the MSB of the intensity data shown in FIG. 11.
FIG. 18 is a plan view of the 3×9 array of image pixels showing the binary data used during a second refresh period to display the MSB of the intensity data shown in FIG. 11.
FIG. 19 is a timeline showing the location of certain bits in some but not all refresh periods according to one embodiment of the present invention.

FIG. 19 shows one complete frame period 1902 comprised of four refresh periods 1904, 1906, 1908, and 1910. The frame 1902 is displayed at a 24 Hz rate, which the refresh periods have a 96 Hz rate. FIG. 19 is not to scale, and only illustrates the concept of bit independence. Actual bit sequences generally are not displayed in order of significance, nor are the larger data bits displayed as a single period.

In FIG. 19, the MSBs are displayed at a 96 Hz refresh rate by including the MSBs in each of the refresh periods. Bit 4 from Table 2 above is represented by 40 μS period 1914, which is displayed at a 96 Hz frame rate in each refresh period. Bit 3 is a 20 μS period 1916 that is also included in each of the four refresh periods. Bit 2 is a 20 μS period 1918 that is only displayed at a 48 Hz rate. Therefore, bit 2 is only included in the first 1904 and third 1908 refresh periods each frame. Bit 1 is a 10 WS period 1920 displayed in the second 1906 and fourth 1910 refresh periods. Bit 0 is also a 10 WAS period 1922 that is only displayed in the second refresh period 1906. A review of FIG. 19 and Table 2 shows that the fourth refresh period 1910 is 10 μS shorter than the other refresh periods.

Summing the display periods for each bit over an entire frame returns the binary relationship between the bits. Referring to FIG. 19 and Table 2, bit 0 has a total display period of 10 μS over the entire frame period 1902. Bit 1 has a total display period of 20 μS over the entire frame period 1902. Bit 2 has a total display period of 40 μS over the entire frame period 1902. Bit 3 has a total display period of 80 μS over the entire frame period 1902. Bit 4 has a total display period of 160 μS over the entire frame period 1902.

Spatial-Temporal Multiplexing:

Displaying various image bits at different refresh rates avoids flicker enables the display of greater gray level displays for a given minimum bit duration. The number of gray levels possible from a given display system is increased further by the combination of the variable refresh rate described above and the techniques of spatial-temporal multiplexing and ternary bits.

Spatial-temporal multiplexing is a technique used to increase the range of gray scale images, or bit depth, of a display system while maintaining an acceptable minimum bit duration. Spatial-temporal multiplexing applies a varying spatial mask to the image data for one or more of the LSB bit planes. The mask varies over time such that the on period of each pixel is limited over time. The viewer is unable to detect the spatial and temporal dithering.

For example, if the 50% checkerboard pattern of FIG. 9*a* is used to mask the LSB for half of each frame period, and the 50% checkerboard pattern of FIG. 9*b* is used for the other half, each LSB is only displayed half of the frame period. The human eye integrates the intensity of the pixel during both frame halves, in effect creating a ½ LSB bit period. Of course, if the LSB of the image data for a given pixel is 0, the pixel will be off during both of the frame halves.

Other mask patterns are used to create additional intensity levels. For example, 25% and 12.5% patterns are possible to further reduce intensity steps without requiring shorter bit plane periods.

Ternary Bits:

Yet another method of reducing the intensity step size without reducing the minimum bit plane duration uses ternary bits planes. Ternary bit planes have three possible values. For example, using spatial-temporal multiplexing, a given bit plan can have a duty cycle of 0%, 50%, or 100%—thereby producing three different output levels. Multiple ternary bit planes allow many more intensity increments than are available using binary bit planes. An example of spatial-temporal multiplexing using ternary bit planes will be described in reference to FIGS. 9 through 19.

FIGS. 9 and 10 are plan views of a 3×9 array of pixels showing the spatial-temporal masks used to provide a 50% duty cycle intensity value. FIG. 11 is a plan view of the 3×9 array of pixels showing a decimal value of image data for each pixel. FIG. 12 shows the same array illustrating the duty cycle for each of three spatial-temporal bit plans. Assuming the duration of the least significant bit plane is equal to 1 LSB, the most significant bit plane has a duration of 9 LSBs, allowing the most significant bit plane to contribute 0, 4.5, or 9 LSBs to the pixel intensity. The middle spatial-temporal bit has a duration of 3 LSBs, allowing the bit plane to contribute 0, 1.5, or 3 LSBs to the pixel intensity. The least significant bit plane has a duration of only 1 LSB and therefore contributes either 0, 0.5, or 1 LSB to the pixel intensity. Since 1 LSB is defined as the 100% duty cycle minimum bit plane, the minimum intensity increment is 0.5 LSB, not 1 LSB as would be expected. Table 3 lists the decimal value, bit plane duty cycles, and effective intensity for each intensity step from 0 to 26.

TABLE 3

Sample Bit Plane Intensity Levels With Spatial-Temporal Multiplexing

| Decimal | Bit Plane Duty Cycle | | | Bit Plane Intensity (LSBs) | | | Intensity |
|---|---|---|---|---|---|---|---|
| Intensity | MSB | Middle | LSB | MSB | Middle | LSB | (LSBs) |
| 0 | 0% | 0% | 0% | 0.0 | 0.0 | 0.0 | 0.0 |
| 1 | 0% | 0% | 50% | 0.0 | 0.0 | 0.5 | 0.5 |
| 2 | 0% | 0% | 100% | 0.0 | 0.0 | 1.0 | 1.0 |
| 3 | 0% | 50% | 0% | 0.0 | 1.5 | 0.0 | 1.5 |
| 4 | 0% | 50% | 50% | 0.0 | 1.5 | 0.5 | 2.0 |

TABLE 3-continued

Sample Bit Plane Intensity Levels With Spatial-Temporal Multiplexing

| Decimal | Bit Plane Duty Cycle | | | Bit Plane Intensity (LSBs) | | | Intensity |
|---|---|---|---|---|---|---|---|
| Intensity | MSB | Middle | LSB | MSB | Middle | LSB | (LSBs) |
| 5 | 0% | 50% | 100% | 0.0 | 1.5 | 1.0 | 2.5 |
| 6 | 0% | 100% | 0% | 0.0 | 3.0 | 0.0 | 3.0 |
| 7 | 0% | 100% | 50% | 0.0 | 3.0 | 0.5 | 3.5 |
| 8 | 0% | 100% | 100% | 0.0 | 3.0 | 1.0 | 4.0 |
| 9 | 50% | 0% | 0% | 4.5 | 0.0 | 0.0 | 4.5 |
| 10 | 50% | 0% | 50% | 4.5 | 0.0 | 0.5 | 5.0 |
| 11 | 50% | 0% | 100% | 4.5 | 0.0 | 1.0 | 5.5 |
| 12 | 50% | 50% | 0% | 4.5 | 1.5 | 0.0 | 6.0 |
| 13 | 50% | 50% | 50% | 4.5 | 1.5 | 0.5 | 6.5 |
| 14 | 50% | 50% | 100% | 4.5 | 1.5 | 1.0 | 7.0 |
| 15 | 50% | 100% | 0% | 4.5 | 3.0 | 0.0 | 7.5 |
| 16 | 50% | 100% | 50% | 4.5 | 3.0 | 0.5 | 8.0 |
| 17 | 50% | 100% | 100% | 4.5 | 3.0 | 1.0 | 8.5 |
| 18 | 50% | 0% | 0% | 4.5 | 0.0 | 0.0 | 9.0 |
| 19 | 100% | 0% | 50% | 9.0 | 0.0 | 0.5 | 9.5 |
| 20 | 100% | 0% | 100% | 9.0 | 0.0 | 1.0 | 10.0 |
| 21 | 100% | 50% | 0% | 9.0 | 1.5 | 0.0 | 10.5 |
| 22 | 100% | 50% | 50% | 9.0 | 1.5 | 0.5 | 11.0 |
| 23 | 100% | 50% | 100% | 9.0 | 1.5 | 1.0 | 11.5 |
| 24 | 100% | 100% | 0% | 9.0 | 3.0 | 0.0 | 12.0 |
| 25 | 100% | 100% | 50% | 9.0 | 3.0 | 0.5 | 12.5 |
| 26 | 100% | 100% | 100% | 9.0 | 3.0 | 1.0 | 13.0 |

FIGS. 13 and 14 show the pixel values for two sequential instances of the LSB bit plane. The top row of pixels is always off in both FIGS. 13 and 14 since, as shown in FIG. 12 and Table 3, the LSB is not used to create any of the intensity levels of the top row of pixels. Likewise, the bottom row of pixels in FIGS. 13 and 14 is always on. The middle row of pixels in FIGS. 13 and 14, as indicated by FIG. 12, all have a 50% duty cycle. The mask patterns of FIGS. 9 and 10 are used to determine which pixels are on during the first instance of the LSB bit plane (FIG. 13), and which of these pixels are on during the second instance of the LSB bit plane (FIG. 14).

FIGS. 15 and 16 show the pixel values for two sequential instances of the middle bit plane. The first, fourth, and seventh columns of pixels are always off in both FIGS. 15 and 16 since, as shown in FIG. 12 and Table 3, the middle bit is not used to create any of the intensity levels in these columns of pixels. Likewise, the third, sixth, and ninth columns of pixels in FIGS. 15 and 16 are always on. The second, fifth, and eighth columns of pixels in FIGS. 15 and 16, as indicated by FIG. 12, all have a 50% duty cycle. The mask patterns of FIGS. 9 and 10 are used to determine which of these pixels are on during the first instance of the middle bit plane (FIG. 15), and which pixels are on during the second instance of the middle bit plane (FIG. 16).

FIGS. 17 and 18 show the pixel values for two sequential instances of the MSB bit plane. The first three columns of pixels are always off in both FIGS. 17 and 18 since, as shown in FIG. 12 and Table 3, the MSB is not used to create any of the intensity levels in these columns of pixels. Likewise, the seventh, eighth, and ninth columns of pixels in FIGS. 17 and 18 are always on. The fourth, fifth, and sixth columns of pixels in FIGS. 17 and 18, as indicated by FIG. 12, all have a 50% duty cycle. The mask patterns of FIGS. 9 and 10 are used to determine which of these pixels are on during the first instance of the MSB bit plane (FIG. 17), and which pixels are on during the second instance of the middle bit plane (FIG. 18).

Non-Terminated PWM Sequences:

Yet another improvement to reduce flicker in low frame rate displays is the use of non-terminated, or hanging PWM sequences. Because the duration of each bit in a sequence has a precise relationship to the duration of all of the other bits, and because the minimum bit duration is somewhat limited as described above, the sum of all bit durations often does not exactly equal the available frame period. Many systems simply turn off all of the pixels of the modulator during this dead time between the end of a first bit sequence and the beginning of the next frame period. This dead time creates image flicker at the frame rate. Since the frame rate is fairly low, 24 Hz in some applications, this flicker is likely to be visible even if the dead time is very short. Distributing the dead time between each of the refresh periods makes the flicker much more difficult to detect, but in some instances the flicker is detectable. An alternative is to simply leave the pixels set in the state determined by the last bit plane of each frame until the beginning of the next frame period. This alternative alters the relationship of the bits, and slightly increases the intensity of the image compared to the practice of turning the pixels off during the dead time, but helps to eliminate flicker.

Low Flicker High Bit Depth Display:

Tables 4 and 5 detail four possible bit sequences according to one embodiment of the present invention. In Table 4, each of the four sequences is listed. The description is comprised of the number of non-STM bits (Ax), followed by the number of STM bits (Sx) used in the sequence. The description further lists the frame rates at which various bits of the sequence are refreshed. The four sequences in Table 4 all refresh each bit at either a 96 or a 24 Hz rate. From Table 4, it is seen that sequences A9S3-96/48(A) and A10S2-96/48(A) have very short minimum bit plane durations (3.3 μS and 5.0 μS). Of the remaining two sequences, A9S3-9648(B) is preferred since it has the higher effective bit depth.

In Table 4, three values are used to represent the bit depth of the bit sequence. The effective bit depth represents the equivalent bit depth over the entire range of data values. The minimum bit depth represents the bit depth represented by the worst-case (largest) incremental intensity increase in the range of data values. The maximum bit depth represents the bit depth represented by the best case (smallest) incremental intensity increase in the range of data values.

TABLE 4

Sample Spatial Temporal Bit Durations

| Pattern | Bit Plane Duration | | | | | Bit Depth | | |
|---|---|---|---|---|---|---|---|---|
| Description | A1 | A0 | S2 | S1 | S0 | Eff. | Min. | Max. |
| A9S3-96/48(A) | 22.5 | | 15.0 | 10.0 | 3.3 | 13.8 | 13.8 | 13.8 |
| A9S3-96/48(B) | 22.5 | | 15.0 | 13.3 | 10.0 | 13.8 | 13.8 | 14.8 |
| A10S2-96/48(A) | 22.5 | 11.3 | 7.5 | 5.0 | | 13.2 | 13.2 | 13.2 |
| A10S2-96/48(B) | 22.5 | 11.3 | 5.0 | 15.0 | | 13.2 | 13.2 | 13.2 |

Table 5 shows the allocation of each of the bit planes to the four refresh periods. The bit planes corresponding to the larger non-STM bits (A10 through A1) are not shown in Table 5 because they are displayed in all four of the refresh periods.

TABLE 5

Sample Allocation of Bit Planes to Refresh Period

| Sequence | Refresh #1 | Refresh #2 | Refresh #3 | Refresh #4 |
|---|---|---|---|---|
| A9S3-96/48(A) | S2a, S1a | S2b, S0a | S2a, S1b | S2b, S0b |
| A9S3-96/48(B) | S2a, S1a | S2b, S0a | S2a, S1b | S2b, S0b |
| A10S2-96/48(A) | A0, S2a, S1a | A0, S2b, S0a | A0, S2a, S1b | A0, S2b, S0b |
| A10S2-96/48(B) | A0, S2a, S1a | A0, S2b, S0a | A0, S2a, S1b | A0, S2b, S0b |

Figure 20:
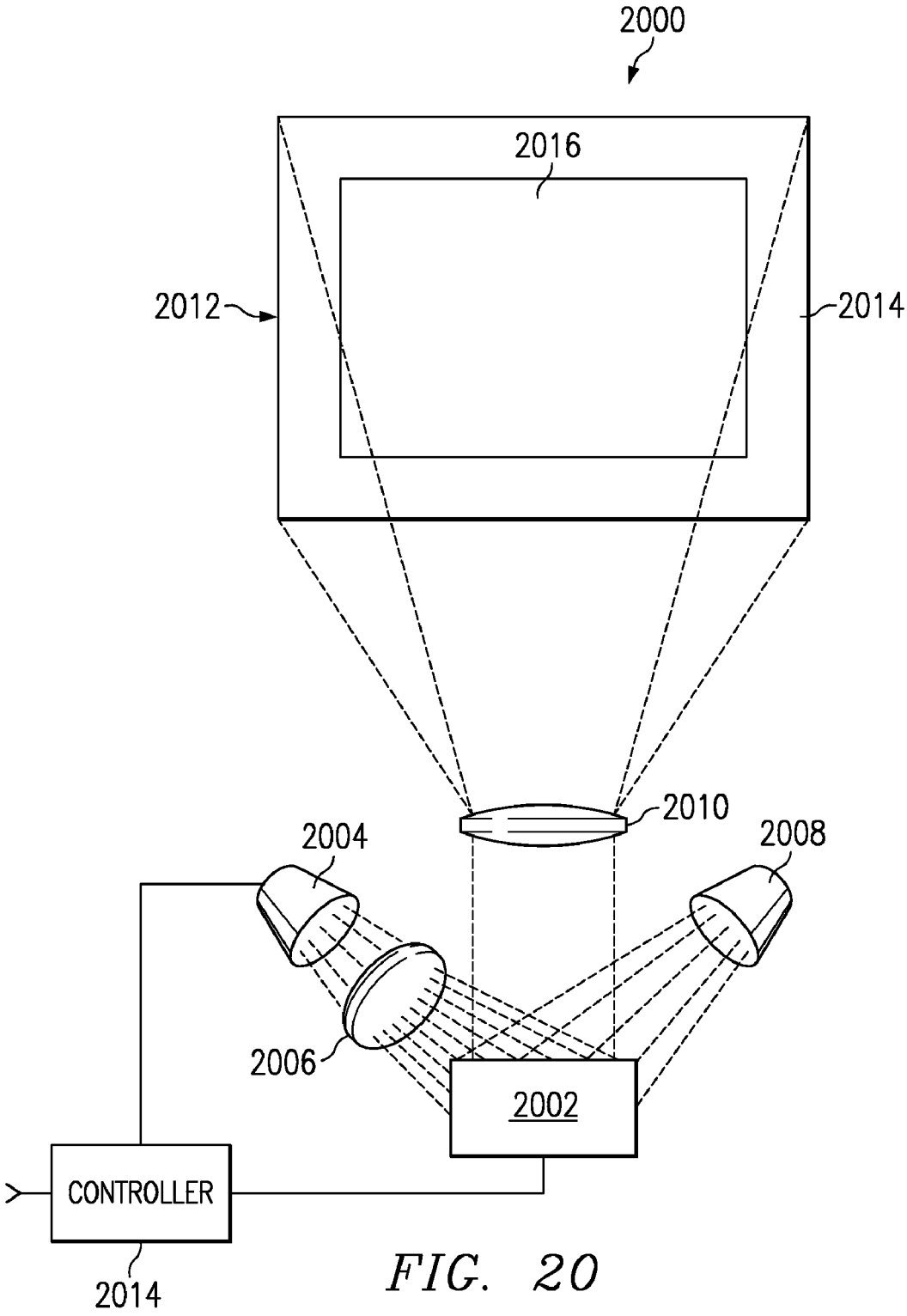
FIG. 20 is a schematic view of a micromirror-based projection system utilizing the independent display of bit planes according to one embodiment of the present invention.

FIG. 20 is a schematic view of an image projection system 2000 using a micromirror 2002 spatial light modulator to display bit planes independently of one another in refresh periods according to the present invention. In FIG. 20, light from light source 2004 is focused on the improved micromirror 2002 by lens 2006. Although shown as a single lens, lens 2006 is typically a group of lenses and mirrors which together focus and direct light from the light source 2004 onto the surface of the micromirror device 2002. Image data and control signals from controller 2014 cause some mirrors to rotate to an on position and others to rotate to an off position. Mirrors on the micromirror device that are rotated to an off position reflect light to a light trap 2008 while mirrors rotated to an on position reflect light to projection lens 2010, which is shown as a single lens for simplicity. Projection lens 2010 focuses the light modulated by the micromirror device 2002 onto an image plane or screen 2012.

Thus, although there has been disclosed to this point a particular embodiment of a system and method for creating low frame rate displays without flickering it is not intended that such specific references be considered as limitations upon the scope of this invention except insofar as set forth in the following claims. Furthermore, having described the invention in connection with certain specific embodiments thereof, it is to be understood that further modifications may now suggest themselves to those skilled in the art, it is intended to cover all such modifications as fall within the scope of the appended claims.

What is claimed is:

1. A method of displaying image data bits, said method comprising the steps of:

receiving an image data word for an image pixel, said image data word comprised of a plurality of bits, wherein each bit of said data word has an associated time period within the image frame period;

dividing an image frame period into at least two refresh periods, each refresh period comprising a period in which bits of said image word are displayed in a same predetermined relative temporal order for each refresh period to reduce flicker, and wherein an accumulated time period associated with each bit over all the refresh periods equals the associated time period for the bit, although not all bits of the image data word are displayed in each refresh period, such that a viewer sees substantially the same image repeated for each refresh period of the frame period.

2. A method of allocating a frame period to image data bits, wherein each image data bit of said data word has an associated time period within the frame period, said method comprising the steps of:

dividing a frame period into at least two refresh periods, each refresh period comprising a period in which at least two image data bits are displayed;

allocating a display period to each image data bit in an m-bit image data word;

determining the a minimum temporal frequency for each of said image data bits, said minimum temporal frequency necessary to prevent each said image data bit from appearing to flicker; and displaying each said image data bit in enough of said refresh periods to achieve said minimum temporal frequency, wherein bits of said image word are displayed in a same predetermined relative temporal order for each refresh period to reduce flicker and wherein an accumulated time period associated with each bit over all the refresh periods equals the associated time period for the bit, although not all of said image data bits are displayed in all of said refresh periods, such that a viewer sees substantially the same image repeated for each refresh period of the frame period.

3. A display system comprising:

a controller for receiving image data and processing said image data, said image data comprised of m image bits for each pixel of an image, said processing allocating a series of refresh periods to said image bits wherein an accumulated time period associated with each bit over all the refresh periods equals an associated time period for the bit for an image frame, although not all bits of said image word are displayed in each refresh period, each refresh period comprising a period in which at least two image bits are displayed in a same predetermined relative temporal order for each refresh period to reduce flicker; and a display device in electrical communication with said controller, said display device for providing a modulated light beam to each of an array of image pixels, said modulation in response to said processed image data from said controller.

4. The method of claim 1, said dividing comprising dividing an image frame period into at least three refresh periods wherein a first said image data bit is displayed during at least one said refresh period, a second said image data bit is displayed during at least two said refresh periods, and a third said image data bit is displayed during at least three said refresh periods.

5. The method of claim 1, said dividing comprising dividing an image frame period into at least three refresh periods wherein a first said image data bit is displayed during at least one said refresh period, a second said image data bit is displayed during at least two said refresh periods, and a third said image data bit is displayed during at least three said refresh periods and wherein said first, second, and third image data bits are displayed during different numbers of refresh periods.

6. The method of claim 2, said dividing comprising dividing an image frame period into at least three refresh periods wherein a first said image data bit is displayed during at least one said refresh period, a second said image data bit is displayed during at least two said refresh periods, and a third said image data bit is displayed during at least three said refresh periods.

7. The method of claim 2, said dividing comprising dividing an image frame period into at least three refresh periods wherein a first said image data bit is displayed during at least one said refresh period, a second said image data bit is displayed during at least two said refresh periods, and a third said image data bit is displayed during at least three said refresh periods and wherein said first, second, and third image data bits are displayed during different numbers of refresh periods.

8. The display of claim 3, wherein a first said image data bit is displayed during at least one said refresh period, a second said image data bit is displayed during at least two said refresh periods, and a third said image data bit is displayed during at least three said refresh periods.

9. The display of claim 3, wherein a first said image data bit is displayed during at least one said refresh period, a second said image data bit is displayed during at least two said refresh periods, and a third said image data bit is displayed during at least three said refresh periods and wherein said first, second, and third image data bits are displayed during different numbers of refresh periods.

* * * * *